US005477657A

United States Patent [19]

Vanhook et al.

[11] Patent Number: 5,477,657

[45] Date of Patent: Dec. 26, 1995

[54] METHOD OF STACKING A SUPPLY OF HOOKS ON A CARD

[75] Inventors: William Z. Vanhook, York, S.C.; John A. Walton, Charlotte, N.C.

[73] Assignee: Roberts Systems, Inc., Charlotte, N.C.

[21] Appl. No.: 214,834

[22] Filed: Mar. 17, 1994

[51] Int. Cl.[6] ..... B65B 15/00; B65B 17/02; B65B 35/56

[52] U.S. Cl. ..... 53/397; 53/156; 53/255; 53/443; 53/446; 206/338; 206/477

[58] Field of Search ..... 53/397, 443, 446, 53/447, 448, 445, 262, 261, 255, 156, 157, 544, 531, 542; 206/337, 338, 340, 348, 427

[56] References Cited

U.S. PATENT DOCUMENTS 2,285,433 5/1942 Hermsdorf ..... 206/337 X
2,662,596 12/1953 Weaver et al. ..... 206/337 X
3,347,360 10/1967 Saltz ..... 206/338
3,383,826 5/1968 Batts ..... 53/397
3,955,336 5/1976 Fern et al. ..... 53/544 X

*Primary Examiner*—James F. Coan
*Attorney, Agent, or Firm*—Hardaway Law Firm

[57] ABSTRACT

A dispensing apparatus for housing a stacked supply of hooks which permits the individual withdrawal of a lowermost hook from the stack. A dispensing apparatus provides a chamber having an open top, a rear wall, two side walls, a front wall, a spaced floor providing a gap between the floor and the front wall, the front wall providing a longitudinal opening transversing the wall, the opening permitting the passage of a loop portion of each hook.

2 Claims, 6 Drawing Sheets

METHOD OF STACKING A SUPPLY OF HOOKS ON A CARD

BACKGROUND OF THE INVENTION

This invention is directed towards a process and apparatus for providing apparel hooks for use in packaging clothes.

Apparel hooks are widely used in the apparel industry to package socks as well as other items for hanging hook displays. Typically, hooks are supplied to the apparel industry in bulk and must be manually withdrawn from the bulk supply and inserted over the item in preparation for shipping and retail display.

Traditionally, the bulk supply of clip hooks has been necessary because there has been no reliable process for supplying hooks in an organized and useful orientation and no apparatus exists for dispensing organized hooks. The bulk supply of hooks has several disadvantages. One, labor costs are increased because of the handling steps of selecting and separating a single hook from a bulk supply of hooks. Further, hooks tend to become entangled which requires additional separating efforts. In addition, bulk supplied hooks are typically deposited upon work tables where workers manually separate and install the hooks. Hooks often become separated and strewn on the work place floor where they constitute both a work hazard as well as a hinderance to wheeled carts used to transport inventory.

Further, the repetitive motion of continuously selecting and separating hooks from the bulk supply is a labor intensive step and may be a contributing factor in work related metacarpal syndrome. As a result, there is room for improvement in furnishing an improved hook dispensing apparatus and method of organizing the hooks which addresses the limitations of the prior art.

SUMMARY OF THE INVENTION

It is thus an object of this invention to provide an apparatus to facilitate the presentation and singulation of apparel hooks to an operator.

It is a further object of this invention to provide an apparatus for dispensing a stacked supply of apparel hooks.

It is still a further object of this invention to provide an apparatus for singulating hooks from a stacked supply.

It is still a further and more particular object of this invention to provide an apparatus for retaining a supply of identically oriented hooks.

It is a further and more particular object of this invention to provide a process of organizing and stacking a supply of hooks.

These and additional objects of the invention are provided by a hook dispensing apparatus comprising a housing defining a chamber, the housing having a rear wall, a first side wall, a second side wall, a front wall, the front wall defining a longitudinal opening, the opening being in communication with the chamber, the front wall further defining a horizontal slot along a lower wall edge; a floor beneath said horizontal slot, the floor having a notch traversing an edge of the floor; a support member carrying the housing; wherein, when the chamber receives a vertically stacked supply of hooks, a loop of each individual hook is in communication with the horizontal slot, the loop of a lowermost hook being adjacent to the notch in the slot the slot permitting individual withdrawal of the lowermost hook from the apparatus.

An additional object of this invention is provided by a process of providing a stack supply of hooks comprising the following steps: supplying a rotary bowl separator; sequentially feeding oriented hooks from the separator; transporting each oriented hook to a position adjacent a hook biasing member; biasing each hook onto a rod, the rod engaging a loop of each hook; grouping a plurality of the hooks engaged by the rod; inserting a sleeve within a collective gap portion of the plurality of hooks, the sleeve being engaged and retained within the curved inner dimensions of the hook; removing the sleeve carrying the plurality of hooks from the rod.

DETAILED DESCRIPTION

In accordance with this invention, it has been found that an apparatus for dispensing clothing hooks from a stacked orientation can be provided, overcoming disadvantages inherent in the bulk packaging of hooks.

Figure 1:
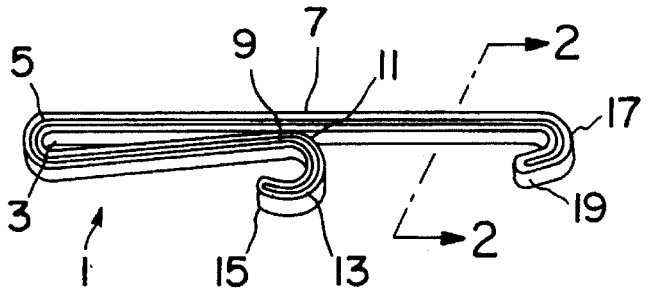
FIG. 1 is a preferred embodiment of a single apparel hook as used in accordance with this invention.

As seen in FIG. 1, a preferred embodiment of a hook 1 used to secure clothing articles for display is shown. Hook 1 has a closed terminus 3 provided by a bend 5 so that hook portions 7 and 9 overlap in close proximity. A gap 11 is defined between hook portion 7 and 9, the gap 11 tapering to a reduced distance adjacent an arcuate loop 13 defined by a first terminus 15 of hook 1. A second curved end 17 of hook 1 forms a second terminus 19.

Figure 2:
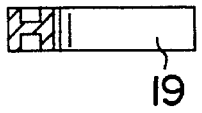
FIG. 2 is a cross section of the hook taken along line 2—2 of FIG. 1.

Hook 1 is preferably constructed of a resilient plastic by injection molding. As best illustrated in FIG. 2, the preferred hook has an I-beam type construction of uniform thickness. Typical hooks are either round in cross-section or have tapered end portions. In accordance with this invention it has been found that the preferred hook seen in FIG. 2 reduces entanglements and thereby permits the hook manipulation steps as taught by the present invention.

Figure 3:
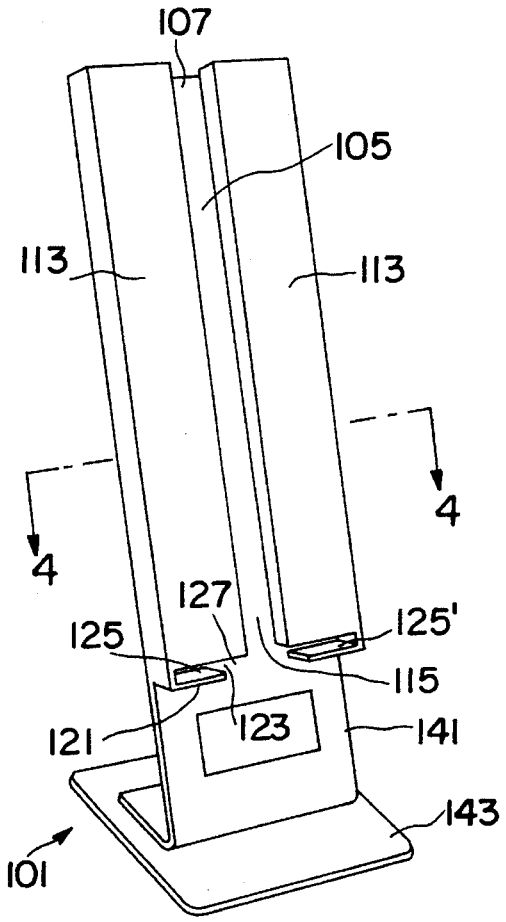
FIG. 3 is a perspective view of a preferred embodiment of this invention.
Figure 4A:
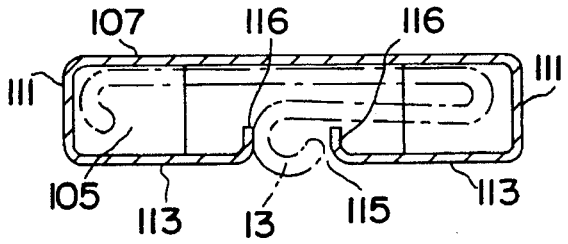
FIGS. 4*a* and 4*b* are sectional views as seen along line 4—4 of FIG. 3 showing additional details of the invention along with varying hook orientations.
Figure 4B:
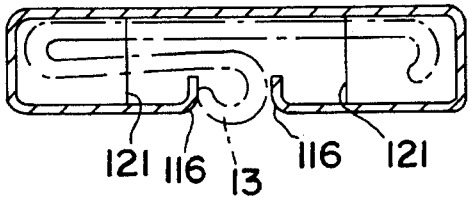

As best seen in FIG. 3–4*b*, a preferred embodiment of a dispensing apparatus 101 is provided comprising a housing 103, said housing further defining a chamber 105. Chamber 105 is enclosed by a rear wall 107 and a pair of side walls 111. A two-part front retaining wall 113 is spaced so as to further define chamber 105. The two parts of wall 113 define an opening 115 in communication with chamber 105.

A lower edge of wall 113, in proximity to a floor 121, forms a first gap portion 125 and a second gap portion 125' between an edge of wall 113 and floor 121. Floor 121 and gap portions 125 and 125' collectively define a hook withdrawal slot 127.

As seen in the preferred embodiment, the longitudinal opening 15 is defined by an inwardly directed bend of walls 113 and 113, each bend defining a lip 116 along the oppositely spaced portions of front wall 113. Opening 115 in combination with the lips 116, provides a passage through which the loop 13 of a stack supply of hooks can pass, the pair of lips securing loop 13 from lateral movement while within the chamber.

In the preferred embodiment, chamber 105 dimensions are symmetrical and permits left or right-handed oriented hooks to be engaged without any further modification to the chamber or chamber orientation. The lips 116 associated with opening 115 secures the hook loops 13 in either orientation. A break or notch 123 in floor 121 permits loop 13 to be easily grasped. In the preferred embodiment, rear wall 107 is continuous with a curved resilient support member 141, which is in turn carried by a base 143.

Figure 5:
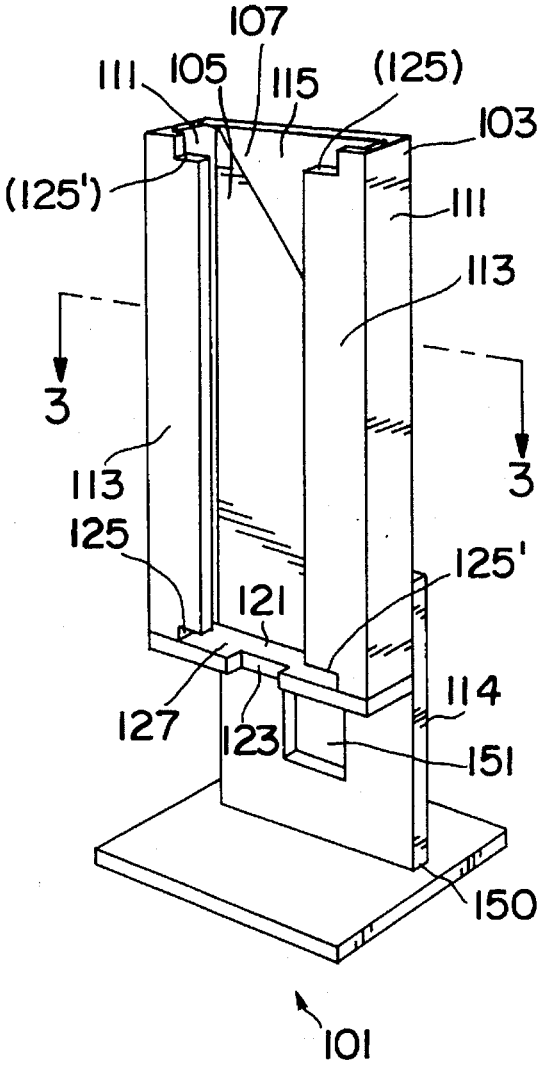
FIG. 5 is a perspective view of an alternative embodiment of the invention.
Figure 6:
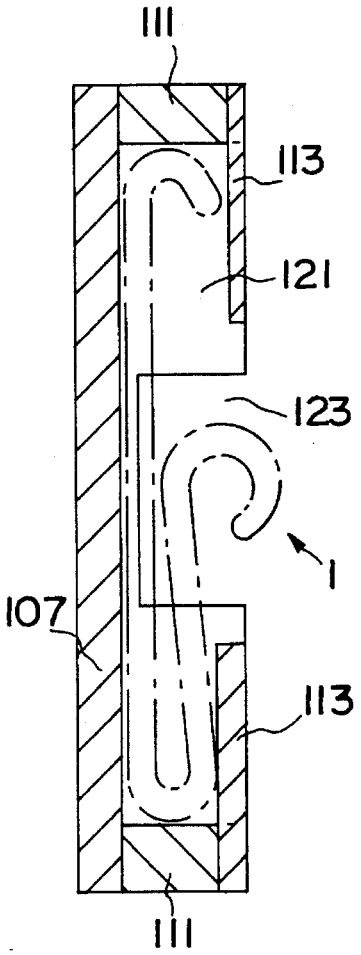
FIG. 6 is a sectional view as seen in the direction of line 6—6 of FIG. 5 and showing hook details in phantom.

In an alternative embodiment seen in FIGS. 5 and 6, the floor 121 further defines an entire bottom support surface of chamber 105. A notch 123 extends across an edge of floor 121 and extends through an upper and lower floor surface. Notch 123 permits manual access to the loop portion 13 of the lowermost hook. When loop portion 13 is grasped, slot 127 permits the withdrawal of the hook from the apparatus 101.

As illustrated in the alternative embodiments, the orientation of hooks in relationship to notch 123 are ideally suited for right-handed users to permit withdrawal of single hooks so that gap 11 is in an open position for engaging an article held in the users left hand. Alternatively, a well-known mechanical discharge assistant can be provided in which a pin, plate, or other typical biasing means is used to engage and present the lowermost hook for withdrawal by the user. Upon withdrawal of the hook, a well-known sensor can be activated which is in Communication with the biasing means thereby providing a signal for engaging the sequential hook with the biasing means.

To maintain proper orientation of the hooks, the dimensions of chamber 105 seen in the alternative embodiment of FIGS. 5 and 6 is configured to permit tile insertion of sleeved hooks only in the desired orientation. Bend 19 of hook 1 requires a greater clearance width than bend 5. Accordingly, chamber 105 is constructed or adjusted so that only the desired right handed hook orientation will fit within the chamber.

Alternatively, the above described embodiment can be constructed so as to permit left-handed withdrawal of the hooks. This is easily accomplished by adjusting the clearance width required by chamber 105 so that only left handed oriented hooks will be accepted.

Figure 7:
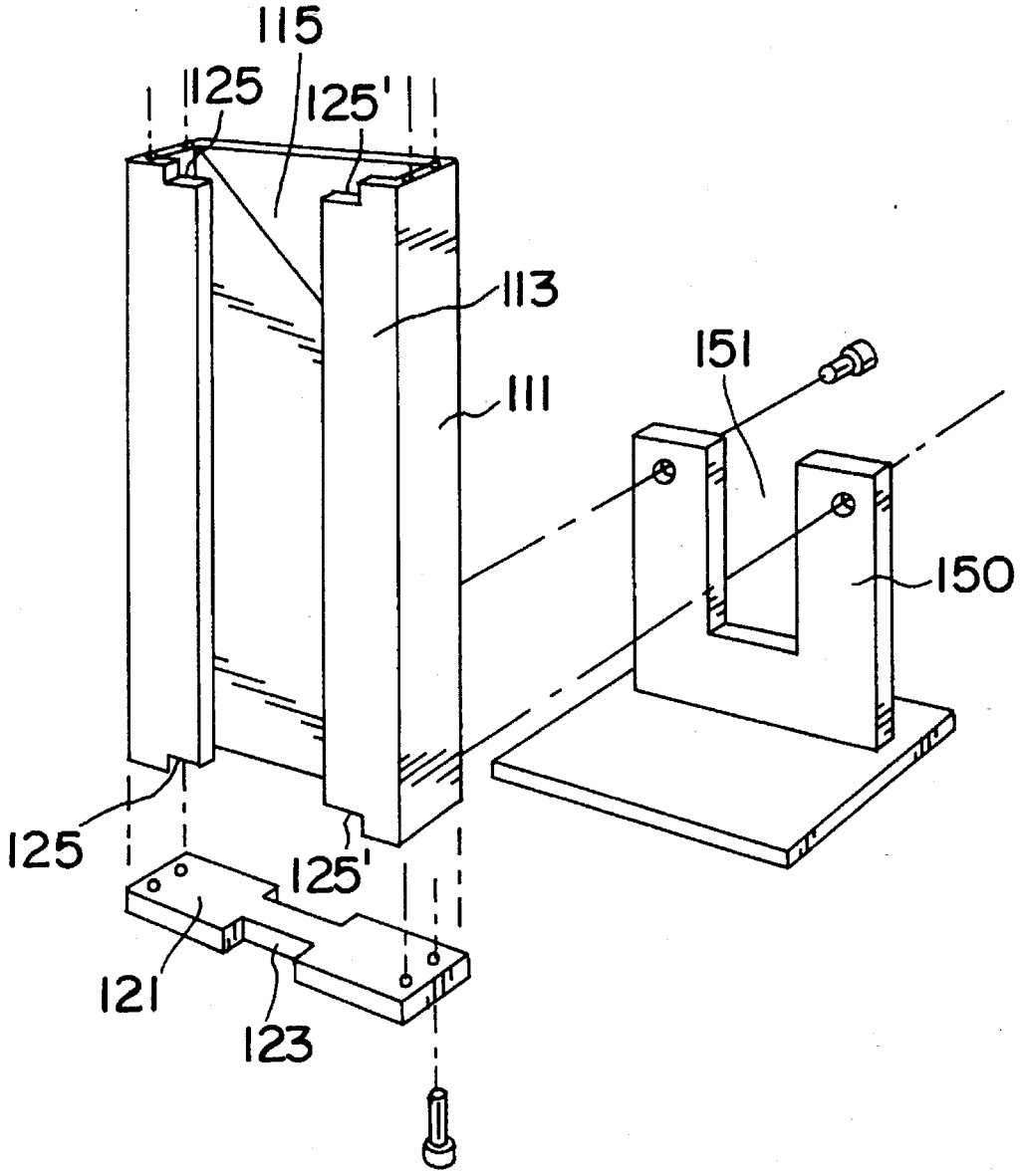
FIG. 7 is an additional alternative embodiment of the present invention.

An additional alternative embodiment is to provide a dispensing apparatus 101 in which the rear, side, and front walls of the chamber are detachable as a unit from the bottom support 121. As best seen in FIGS. 5 and 7, by providing similar gaps 125 & 125' at the upper front portion of wall 113, the detached portion of the chamber can be inverted and reattached to the bottom support 121, providing an apparatus for left-handed hook presentation. In these alternative embodiments, a single notch 123 can be provided with a sufficiently large opening to permit both left and right handed hook withdrawal. An equivalent structure for changing hook orientation can be provided by a second notch 123' opposite notch 123. Notch 123' is positioned and configured for left handed hook presentation. Such an embodiment would require that the chamber be detached, inverted, and rotated 180° before reattaching to surface 127. With this embodiment seen in FIG. 7, base support 150 is provided with an opening 151 through which the left-handed oriented hooks can be accessed. Therefore, simple removal and inversion of the detached portion of the chamber will change the hook orientation. This reattachment and inversion provides a dispensing apparatus for the rapid switching from right-handed to left-handed hook orientations.

To ease user fatigue the apparatus can be attached to a base or other support through a pivoting type attachment means such as a threaded screw. A pivoting means would permit angled adjustments of the chamber relative to the base and permit the operator to vary the angle while the apparatus is being used, thereby lessen the likelihood of repetitive motion injury caused by a fixed orientation.

The preferred embodiment seen in FIG. 3 enables a single dispenser to engage a variety of different size hooks, up to the maximum width of chamber 105. Smaller length hooks will readily engage the apparatus, opening 115 and lips 116 providing the securing force needed to retain the stack supply of hooks within chamber 105.

Figure 9:
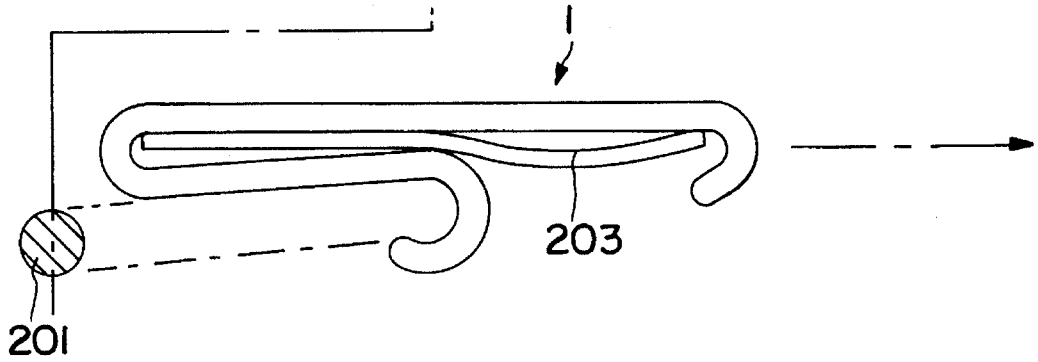

The preferred use of the above described embodiments all take advantage of the ability to provide a carded sleeve of oriented hooks which are retained on a card 203 as seen in FIG. 9. Each card can carry a supply of hooks sufficient to reside within chamber 105. The carded hooks are inserted so that the hooks assume the desired orientation. The card is then manually removed from the hooks, the hooks being retained within the chamber of the dispensing apparatus.

In order to provide carded hooks for use with the dispensing apparatus, it has been necessary to develop an apparatus and process for efficiently installing the hooks on a card. In accordance with this invention it has been found that a novel process for manufacturing and dispensing injection molded hooks can be provided.

Figure 12:
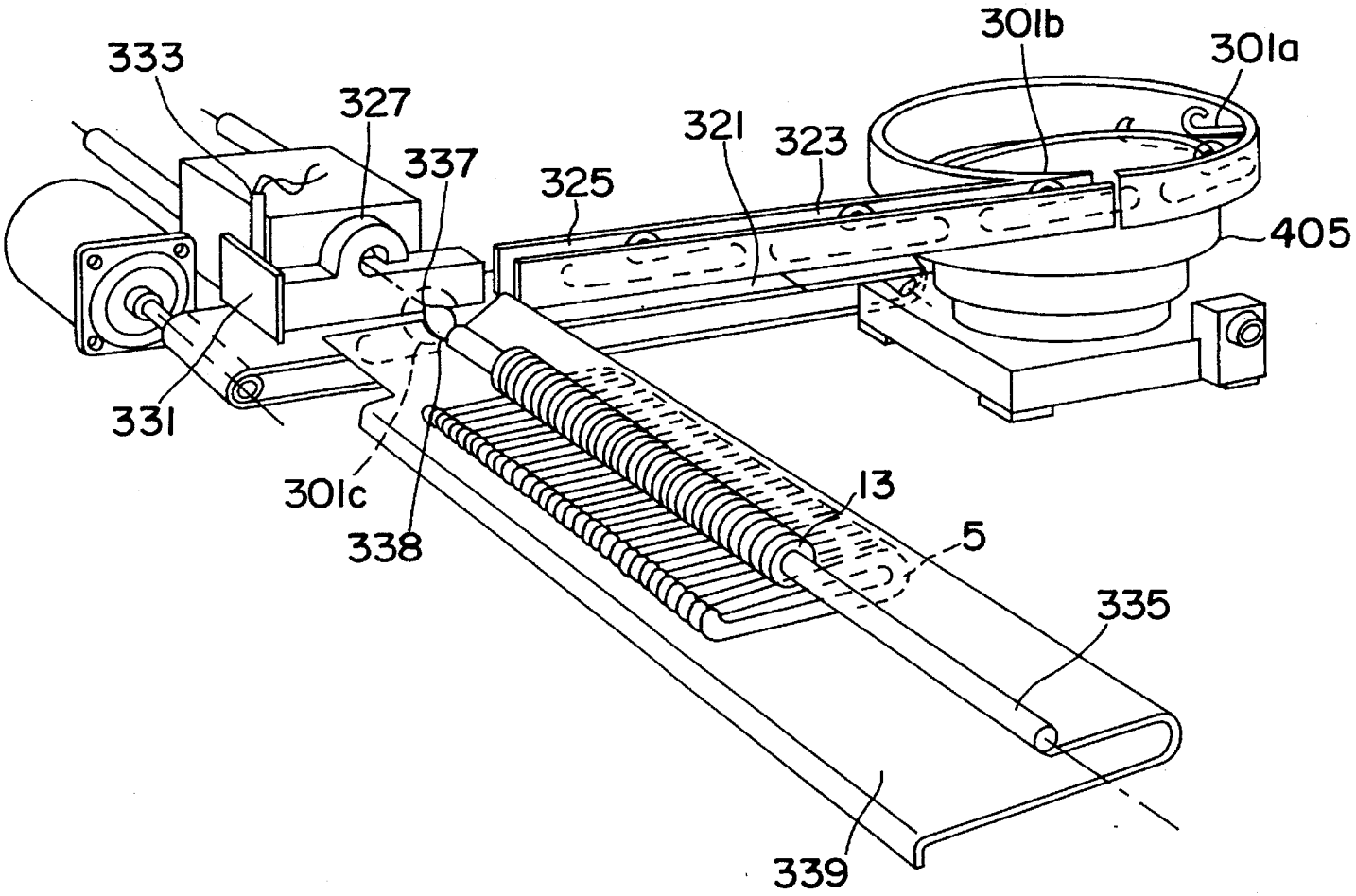
FIG. 12 shows a preferred apparatus and a preferred process for supplying a plurality of aligned hooks for subsequent handling as described in accordance with this invention.

A preferred apparatus for providing a stacked supply of hooks is seen and described in reference to FIG. 12. As a plurality of hooks are injection molded, the entire pattern is fed into a rotating scrimp remover which detaches and separates individual hooks 1 from the associated tree 403. The loose and unoriented supply of hooks is introduced into a rotary bowl separator 405. The use of rotary bowl separators is well known in the art and is used to apply centrifugal force to sequentially track individual articles to a discharge point. Well known sensing and biasing means are used to detect and return improperly oriented hooks to the pool of hooks located within the bowl separator. As a result of the sensing means, only a pre-selected hook orientation will exit the bowl separator 405, the hooks having the configuration and orientation as seen as hook number 301*a* in reference to FIG. 12.

As hook 301*a* exits the centrifugal bowl separator, an air jet directs hook 301*a* to an adjacent belt conveyor at 321 which passes beneath and in communication with an upright track 323. As seen in reference to hook 301*b*, the upright and oriented hook 301*b* is directed to conveyor 321. Preferably, track 323 is offset 5° from vertical so that as hooks are fed along the conveyor, each hook partially rests upon a rear wall 325 of track 323. The 5° offset helps insure that as each hook exits track 323, the hooks are properly positioned for sequential steps.

Conveyor 321 and track 323 directs the hooks to an adjacent pushing member 327. The 5° offset insures that each hook rests upon pusher 327 upon exiting the track. Simultaneously, the conveyor directs hook end 17 against a stop member 331, hook end 17 triggering a light sensor 333. When sensor 333 detects a hook, a signal is sent to the pneumatic control means of pusher 327, causing pusher 327 to laterally displace hook 301*c* so that hook 301*c* engages support rod 335 through hook loop 13.

Rod 335 further comprises a tapered point 337 and an adjacent recessed groove 338 which facilitates the insertion and retention respectively of hooks upon rod 335. As best seen in reference to FIG. 12, as a plurality of hooks 301 are sequentially inserted onto the rod, the action of pusher 327 directs the hooks along the length of rod 335. Rod 335 is carried by an upper surface 336 of a rolled shelf 339, overlapping portions of shelf 339 configured to receive the bend end 5 of hooks 301 as the hooks pass in proximity to the lower shelf surface 339. In the preferred embodiment, the first terminus 15 of the hooks are carried and maintained slightly above the upper shelf surface 339. This feature permits the downward flexing of a desired quantity of adjacent hooks, thereby facilitating the insertion of a plastic, or cardboard, or other resilient card into the hook gaps. A slight flexing increases the gap size and facilitates the insertion and retention of the card within the hook gaps. Following insertion of the card, the resulting sleeve of hooks can be removed from the rail ready for use with the dispensing apparatus 101 set forth above.

The speed of the above process is largely dependant upon the feed rate of hooks from the bowl separator. While the average feed rate of hooks from the bowl separator to the adjacent conveyor and track can be easily quantified for each type of hook, there are short term fluctuations in the hook supply rate. The apparatus provided accommodates these variations in several independent fashions.

For instance, the length of the track and associated conveyor can be a sufficient length that a sudden rapid influx of hooks can be retained within the track. In reference to FIG. 12, conveyor 321 is in continuous operation. However, should two or more hooks be passed in rapid succession along track 323 the sequential installation of hooks upon rod 335 is not disrupted. The response time between sensor 331 detecting a hook and the biasing of the hook by number 327 is so rapid that biasing member or pusher 327 is repositioned for receiving the next incoming hook. Furthermore, the speed of the biasing means relative to the conveyor is such that even adjacent hooks with no spacing in between are installed on the rod in a sequential fashion. When biasing means 327 is actually installing the individual hook on the rod, the edge of biasing means 327 acts as a block, preventing further movement of the adjacent hook until the biasing member has been reset to its original position.

Additional fail-safe methods could be installed as desired such as an additional sensor near the receiving end of conveyor 323 which signals the rotary separator to retain hooks until the sensor signals that the conveyor and track is ready to receive additional hooks.

As described in reference to FIGS. 8–11, an alternative method of orienting hooks is provided. Injection molded hooks are initially formed attached to a central tree 403, the tree and hook arrangement collectively defining a pattern 401. The pattern is readily and accurately reproducible and therefore provides an inherent template for manipulating the individual hooks.

Figure 10:
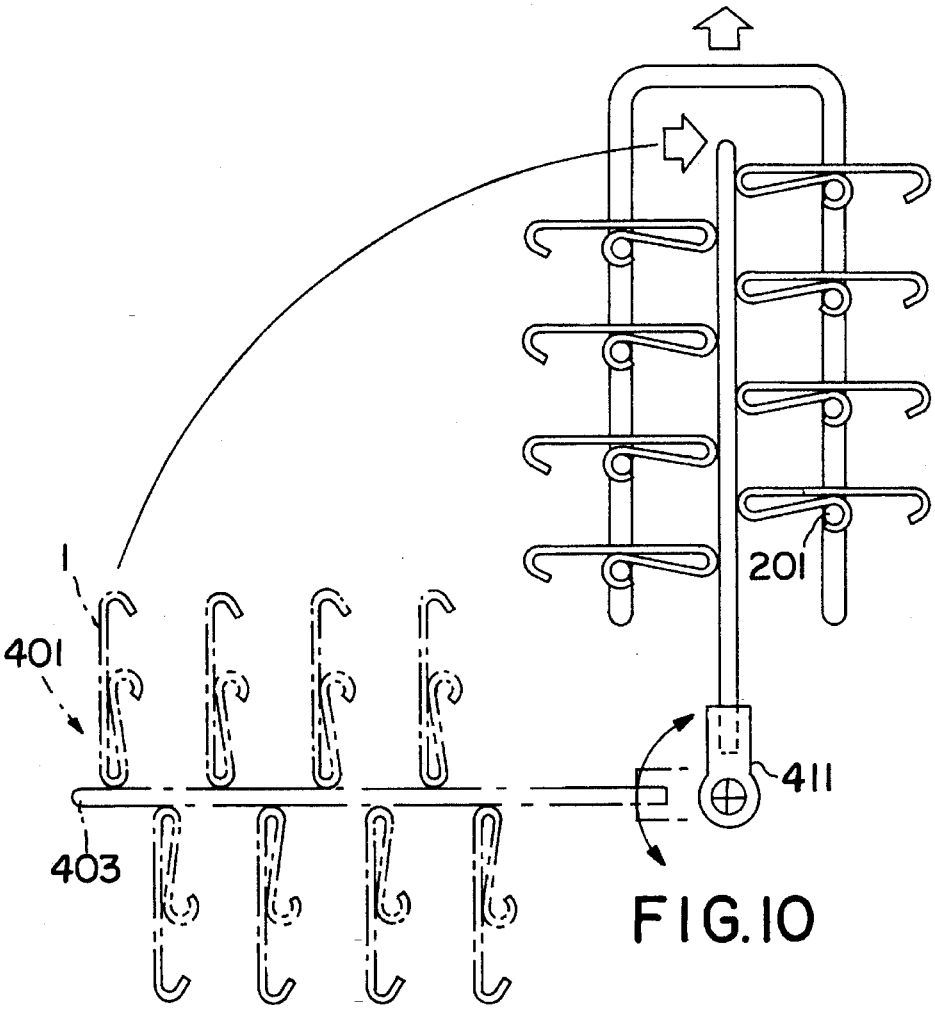
FIG. 10 shows a process of aligning a plurality of hooks for subsequent manipulation.

As seen in reference to FIG. 10 a single pattern 401 is removed from the mold by a pick-up arm 411 which grasps the tree. The pick-up arm carrying the tree pivots to an adjacent position, thereby placing the pattern in proximity to a plurality of engaging rods 201. Each engaging rod 201 preferably has a smooth, rounded exterior surface and is sufficiently narrow to permit the free passage of hook 1 by the engagement of loop 13 over rod 201.

Figure 11:
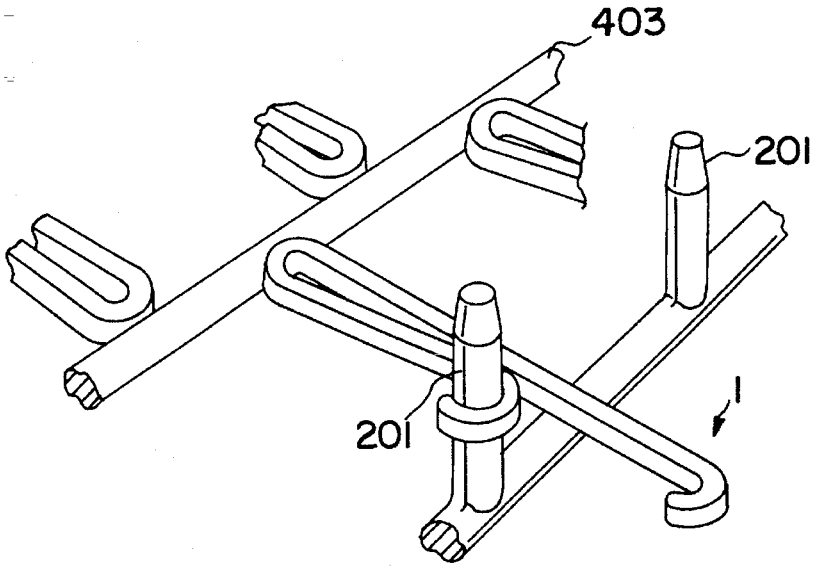
FIG. 11 shows additional details of the step illustrated in FIG. 10 where each single hook is inserted onto a rod.

As best seen in FIG. 11, the engagement arm 411 lowers the pattern upon the engaging rod 201 so that each rod is inserted through loop 13 of the corresponding hook. Following engagement of hooks, the tree hook connections are broken by a mechanical sheer either throughout the movement of the pick-up arm which still engages the tree or through a reciprocating movement of the engagement rod such that the hook attachments to the tree are severed.

Figure 8:
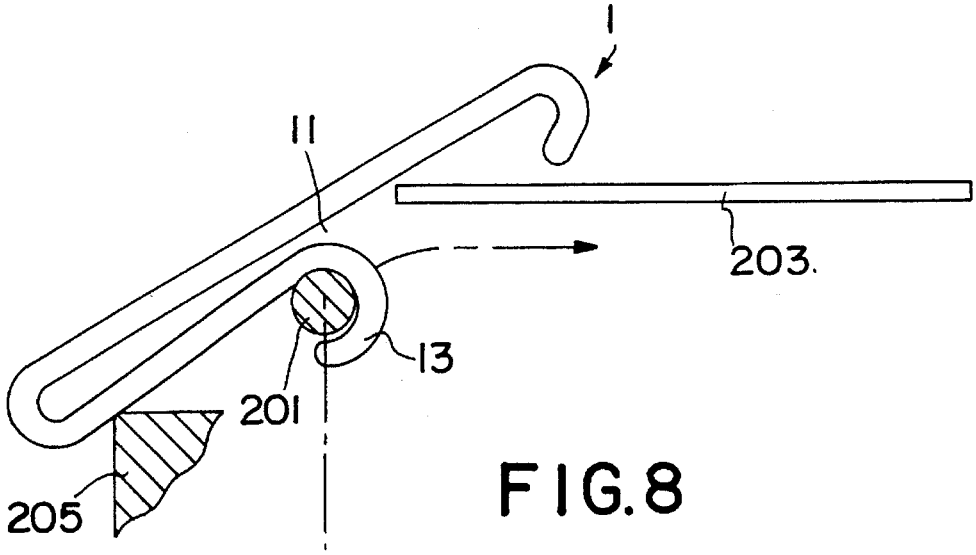
FIGS. 8 through 9 illustrate a process of inserting a card into the gap portion of hooks.

Following the removal of the tree, each hook is engaged solely by its associated rod, hook 1 moving across the engaging rod either in response to gravity or through mechanical transport means. If the supply of hooks are transported to a largely horizontal portion of the rod, the hooks will self-align in response to gravity. Alternatively, a support member 205 can be used to both align and engage the hooks as seen in FIG. 8 so that the hooks are held in a like fixed position with the gap portion 11 of each hook being accessible. As seen in FIG. 9 a first edge of a card 203 is inserted into the gap of a corresponding line of hooks. The second edge of the card is then slightly flexed to engage the curved terminus of the corresponding hook end, thereby securing the card within the confines of the engaged hook. The card and attached hooks, collectively defining a sleeve, are then removed from the engaging rods ready to be inserted into the hook dispensing apparatus.

The above process utilizes the repeating pattern provided by the injection molding process. In this manner, the manufactured hooks are never subject to bulk loading or storage. Therefore, the above method is suitable for a variety of different hook shapes, including round or tapered hooks, which have tend to entangle during bulk manufacturing and shipment but which can now be applied and stored on cards which greatly facilitates the transport and use of the apparel hooks.

The process and apparatus for dispensing the hooks addresses several limitations inherent in the current industry's reliance on bulk supplied hooks. As numerous modifications of the preferred embodiment described above are possible to one having ordinary skill in the art upon reading the description, the scope of the present inventions hereby set forth by the following appended claims.

That which is claimed is:

1. A process of providing a stacked supply of hooks comprising the following steps:

supplying a rotary bowl separator;

sequentially feeding oriented hooks from said separator;

transporting each said oriented hook to a position adjacent a hook biasing member;

biasing each said hook onto a rod, said rod engaging a loop of each said hook;

grouping a plurality of said hooks engaged by said rod;

inserting a card within a collective gap portion of said plurality of hooks, said card being engaged and retained within the curved inner dimensions of said hook;

removing said card carrying said plurality of hooks from said rod.

2. A process of providing a sleeve of hooks comprising the following steps:

providing a supply of apparel hooks;

removing individual hooks from said supply, each said individual hook having a like, predetermined orientation;

placing said individual hook onto a rod, said rod engaging a loop of each said hook;

grouping a plurality of said hooks engaging said rod;

inserting a card within a gap portion of said engaged hooks, said card being retained within the curved inner dimensions of said plurality of hooks;

removing said card engaging said hooks from said rod.

* * * * *